United States Patent [19]

Bärnthaler et al.

[11] Patent Number: 4,662,685

[45] Date of Patent: May 5, 1987

[54] DEVICE FOR SEALING A DRIFT CROSS SECTION DRIVEN BY MEANS OF A CUTTING MACHINE

[75] Inventors: Franz Bärnthaler, Weisskirchen; Ferdinand Bedenk, Zeltweg; Otto Schetina, Zeltweg; Alfred Zitz, Zeltweg, all of Austria

[73] Assignee: Voest-Alpine Aktiengesellschaft, Linz, Austria

[21] Appl. No.: 770,787

[22] Filed: Aug. 29, 1985

[30] Foreign Application Priority Data

Aug. 31, 1984 [AT] Austria ..... A2801/84

[51] Int. Cl.[4] ..... E21C 35/20

[52] U.S. Cl. ..... 299/33; 299/12; 299/64

[58] Field of Search ..... 299/33, 12, 76, 11, 299/64

[56] References Cited

U.S. PATENT DOCUMENTS

| | | | |
|---|---|---|---|
| 3,640,580 | 2/1972 | White | 299/12 X |
| 4,037,875 | 7/1977 | Justice | 299/33 X |
| 4,131,317 | 12/1978 | Jamison et al. | 299/33 X |
| 4,173,373 | 11/1979 | Campbell et al. | 299/11 |

*Primary Examiner*—Stephen J. Novosad
*Assistant Examiner*—Michael A. Goodwin
*Attorney, Agent, or Firm*—Cushman, Darby & Cushman

[57] ABSTRACT

A cutting machine (1) includes on its base frame (3) a carrier construction (19) for wall elements (21) and appliances (20) for drilling anchor bores and applying anchors the carrier construction being shiftable in longitudinal direction of the machine. The wall elements (21) are adjoining the drift roof (22) and, respectively, a cutting arm (11) via elastic sealing elments (23). The cutting arm (11) via elastic sealing elements (23). The ally linked to a shiftable frame (42). The cutting heads (28, 29) can be shifted along guides (31) in transverse relation to the longitudinal axis of the drift, the cutting heads (28, 29) being arranged between drift face (33) and wall elements (21).

6 Claims, 3 Drawing Figures

DEVICE FOR SEALING A DRIFT CROSS SECTION DRIVEN BY MEANS OF A CUTTING MACHINE

Figure 1:
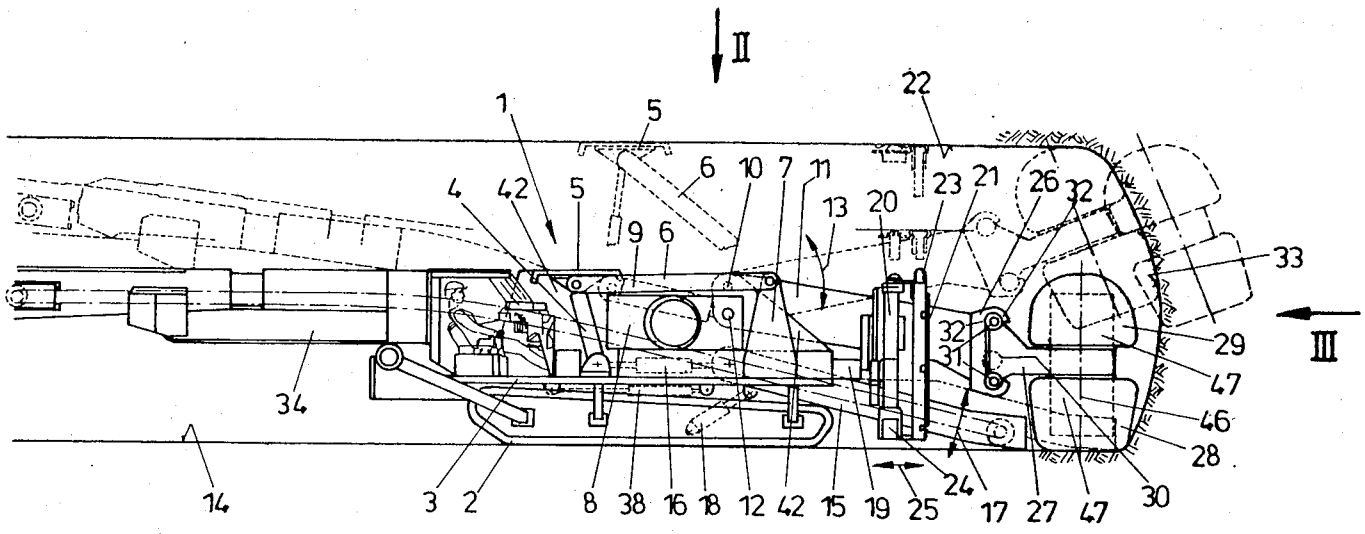

The invention refers to a device for sealing a drift cross section which can be driven by means of a cutting machine.

For driving drifts it has already been proposed to drive, in particular in connection with drift cross sections of greater width, such cross sections at first with reduced width and to drive subsequently parallel thereto a second part of the drift cross section, thereby taking along a flexible curtain which can be shifted in longitudinal direction of the drift. In this manner, the adjacent part of the drift shall be secured against cut material thrown away by the cutting tools.

In connection with a fragile mine roof, it is necessary to consolidate the drift as near as possible up to the drift face, for which purpose there is known a plurality of relatively expensive devices for applying a provisional consolidation which could be replaced some time later by a final consolidation at a secure distance behind the cutting machine. The expenses for such provisional consolidations are relatively considerable, and considerating the fact that the work must be done immediately adjacent the drift face with simultaneous endangering by rock thrown away, there were already developed more or less expensive and fully automatic appliances.

The invention now aims at providing the possibility to apply a final consolidation till near the drift face. In this connection, it has already been proposed to arrange devices for drilling anchor holes and for putting anchors in place directly on a cutting machine, to be in the position to make at least preliminary arrangements for consolidating the drift immediately adjacent the drift face. A final consolidation could not easily be effected with such devices on account of lacking suitable protective measures. For the purpose of providing sufficient protection and for providing the possibility to apply a final consolidation till near the drift face and for solving the above-mentioned task, the invention essentially consists in that the movable cutting machine comprises at least one carrier being shiftable in longitudinal direction of the machine and having mounted on its end extending beyond the front end of the chassis, in particular of the caterpillars, at least one wall element extending transversely to the longitudinal direction and shifting direction of the carrier as well as appliances for drilling anchor bores and applying anchors, in that the wall element or wall elements has (have) on its (their) circumference sealings being elastically deformable and/or being shiftable within the plane of the wall and being adapted to contact the drift profile and in that in the wall element or the wall elements there is provided a perforation corresponding to the outer contour and to the swivelling path of a swivellable cutting arm having arranged on its free end cutting tools and extending through the wall element or the wall elements, the inner circumference of said perforation comprising sealings being elastically deformable and/or being shiftable within the plane of the wall and being adapted to contact the circumference of the cutting arm. On account of the fact that at least one wall element transversely extending relative to the longitudinal direction and shifting direction of the carrier can be advanced by said carrier being shiftable in longitudinal direction of the cutting machine, sealing of the cutting face and drift face, respectively, can be effected immediately behind the cutting tools . For reliably obtaining a tight closure relative to the drift roof and the side wall of the drift, respectively, the wall element or the wall elements has (have) on its and their, respectively, circumference adjustable sealings which are elastically deformable and/or shiftable within the plane of the wall and are thereby adapted to contact the drift profile. Because a cutting machine has a cutting arm in front of the machine frame, the wall element must be designed such that it can be penetrated by the cutting arm without obstructing the cutting arm in its predetermined mobility and direction of movement, respectively. For this purpose, the wall has a perforation corresponding to the outer contour and to the swivelling path of the swivellable cutting arm extending through the wall, the inner circumference of said perforation comprises sealings being elastically deformable and/or being shiftable within the plane of the wall and being adapted to contact the circumference of the cutting arm. On account of such a wall of sealing properties it is now possible to effect the consolidation immediately adjacent the drift face, and for this purpose and according to the invention there is mounted at least one appliance for drilling anchor bores and for applying anchors on the carrier being shiftable in longitudinal direction of the machine. In contrast to known devices having arranged appliances for drilling anchor bores and applying anchors immediately arranged on the cutting arm, the appliance for drilling anchor bores and for applying anchors or a plurality of such appliances, respectively, can be arranged in a substantially vibration-free manner on the longitudinal carriers being shiftably supported on the machine, so that substantially more exact drilled holes can be obtained without disturbing crumbling. Consolidating work is secured and protected by the wall located immediately in front of the working area and in closer proximity to the drift face and, simultaneously to the cutting work and to the drift charging operation, anchor means and consolidation means can be introduced in a predetermined distance of anchor rows. For exactly supporting the carrier for the wall elements, this carrier is preferably shiftably guided within guides extending in longitudinal direction of the cutting machine. Such guiding of the carrier provides the possibility to move the carrier essentially parallely to the drift floor, so that, when maintaining a predetermined nominal profile during cutting work, the bore holes and anchors can exactly be positioned at constant distances. The shiftability of the carrier provides the possibility to adapt, according to the requirements, the distance of the anchor rows in longitudinal direction of the drift without interrupting the cutting work. Consolidation can thus be effected independent from the drift advance and from the advancing speed and simultaneously with the cutting work.

The perforation within the wall held in position by the carrier can, in principle, be designed such that universal swivellability of a cutting arm is reliably maintained. In connection with a universal swivelling movement of the cutting arm it is, however, frequently not possible to move the wall element into close proximity to the drift face, because at this location the deviation of the cutting arm position from the longitudinal axis of the cutting machine becomes already relatively great and the perforation, which shall be sealed by means of adjustable sealings which are elastically deformable or are shiftable within the plane of the wall, would already become relatively great. In such an arrangement it is thus reasonable to admit movability of the cutting arm only in a certain direction, for example in vertical direction, and to prohibit its movability in the respective other direction. This requires the use of specially designed cutting tools which allow to effect cutting work over the whole drift cross section in case of restricted movability of the cutting arm.

A further reduction of the sealing problems and a further uncoupling of the progress of the consolidation work from the progress of the drift advancing work or mining work can be obtained if the cutting arm extending through the shield can be shifted in longitudinal direction of the drift, the shifting drive means of the cutting arm or of the swivelling axis of the cutting arm, respectively, being independent from the shifting drive means of the carrier for the wall element or wall elements. With such a construction it is possible to select in dependence on the swivelled position of the cutting arm a suitable distance of the wall element which will just not obstruct the swivellability of the cutting arm. This arrangement has, in addition, the substantial advantage that advancing the drift in longitudinal direction of the drift can, at least over sections, be effected by only shifting the cutting arm in longitudinal direction of the drift while the cutting machine can maintain at rest in its position. Such a cutting machine can thus be locked in a simple manner against the drift roof, and all these measures serve the purpose to keep low any vibrations of the base frame of the cutting machine. Such a relatively vibration-free base frame of a cutting machine provides a reliable support for the appliances for drilling anchor bores and for applying anchors, and it is substantially easier to obtain clean bore holes without crumbled edges. It is just in connection with fragile drift roofs that sharp-edged bore holes can be obtained only with great difficulties and just such bore holes provide a substantially more operation-safe anchoring of the consolidation. In analogy to the shiftability of the cutting arm in longitudinal direction of the cutting machine, a charging means can additionally be arranged on the frame of the cutting machine for being shiftable relative to the frame in longitudinal direction of the cutting machine, the shifting drive means for said charging means being equally designed as a separate drive means being independent from any other drive means. By separating the drift advancing movement as well as the movement of the charging means from any movement of the cutting machine itself results in a longer residence time of the cutting machine in a reliably locked rest position and thus in facilitating the consolidation work.

For further improving the sealing effect it is reasonable to restrict the swivellability of the cutting arm to a swivelling movement around a substantially horizontal axis and in height direction, because in this manner it is sufficient to give the perforation in the wall element or in the wall elements the shape of a slot extending in height direction. Such a slot can be sealed in a particularly simple manner by means of plate members being shiftable within the plane of the wall or by means of elastically deformable sealing elements, noting that the width of the slot need only surpass the diameter of the cutting arm for an immaterial degree. Particularly simple and short-working cutting devices can be used for such cutting arms being swivellable only in height direction, so that simultaneously a protection or shielding, respectively, can easily be obtained in proximity of the drift face.

By arranging the appliances for drilling anchor bores and applying anchors on the carrier carrying the wall elements it becomes possible to align the mounts along one single line and to reduce the time expenditure for mounting cap elements or roof elements. The wall element can exactly be advanced in normal direction to the longitudinal axis of the cutting machine by means of the carrier being slidably guided within guides of the cutting machine, noting that for driving purposes simple cylinder-piston-aggregates can be used as a linear drive means. In an advantageous manner, separate carrier rails are provided at both sides of the cutting arm or the traversing gear, respectively, which carrier rails are supported for being shiftable beyond the front end of the caterpillar chassis in direction to the drift face, and in such cases the hydraulic shifting drive means of both carrier rails are advantageously coupled one with the other such that parallel shifting movement of the wall elements in direction to the drift face is made sure. Simultaneously with such a parallel shift, during which exact parallelism may be assisted by the wall elements and connections of the wall elements at both sides of the cutting arm, the appliances for drilling anchor bores and applying anchors are oriented in a common drift cross section, so that an exact row of anchor bores and anchors within a common drift cross section can more easily be maintained.

In the following, the invention is further explained with reference to an embodiment, shown in the drawing, of a cutting machine which, in addition to the inventive elements of the shielding, further comprises the preferred elements of the construction of the machine. Therein show FIG. 1 a side elevation of the device according to the invention, FIG. 2 a top in the sense of the arrow II of FIG. 1 and FIG. 3 a front view in direction of the arrow III of FIG. 1.

In FIG. 1, a movable drift advancing machine is designated by 1 and has its caterpillar chassis designated by 2. On the base frame 3 of the drift advancing machine there is arranged a supporting construction comprising an extendable prop 4, a cap 5 to be pressed against the drift roof and a guide rod 6. The extended position of this cap 5 is indicated by dashed lines. The guide rod 6 is pivotally linked to a jack 7. There is further provided a machine distributor 8 which carries hydraulic and electric appliances of the machine.

On the base frame 3, there is further supported a swivelling cylinder 9 which acts on a cutting arm 11 via a pivot point 12 eccentrically relative to the pivot axis 10 of this cutting arm 11. By means of this swivelling cylinder 9 it is possible to swivel the cutting arm 11 in the sense of the twin arrow 13. Swivelling movement is, in this case, restricted to a swivelling movement in a plane vertically extending relative to the floor 14. On the frame 3 of the cutting machine there is further swivellably linked a removal means 15 being shiftable in longitudinal direction of the drift advancing machine 1 by a hydraulic cylinder-piston-aggregate 16, noting that swivellability is made possible in the sense of the twin arrow 17. As a swivel drive means for this swivelling movement in height direction, there is provided a hydraulic cylinder-piston-aggregate 18. The frame 3 of the cutting machine 1 further includes a carrier construction 19 being supported for being shiftable in longitudinal direction of the cutting machine 1 and carrying at its free end an appliance 20 for drilling anchor bores and applying anchors as well as a shielding 21. The shielding 21 can be extended up to the drift roof 22, thereby elastically deforming the sealing elements 23. Likewise, a plurality of appliances 20 for drilling anchor bores and applying anchors can be supported on the drift floor 14 by means of a prop 24 and can be extended till the drift roof 22. The carrier construction 19 is shiftable relative to the frame 3 of the machine in longitudinal direction of the machine 1, which is indicated by the twin arrow 25. The free end of the cutting arm 11 carries a guide 26, in which a carrier 27 for cutting heads 28 and 29 is arranged for being shifted in transverse direction to the longitudinal axis of the drift. The shifting drive means is formed of a hydraulic cylinder-piston-aggregate 30, and in the shown lowered position of the cutting arm 11 there are located two guide tubes 31 of the guide 26 one above the other within a plane substantially extending perpendicular to the drift floor. These guide tubes 31 are embraced by corresponding tubular counter-profiles 32 of the carrier 27. The mining face is designated by 33.

Figure 2:
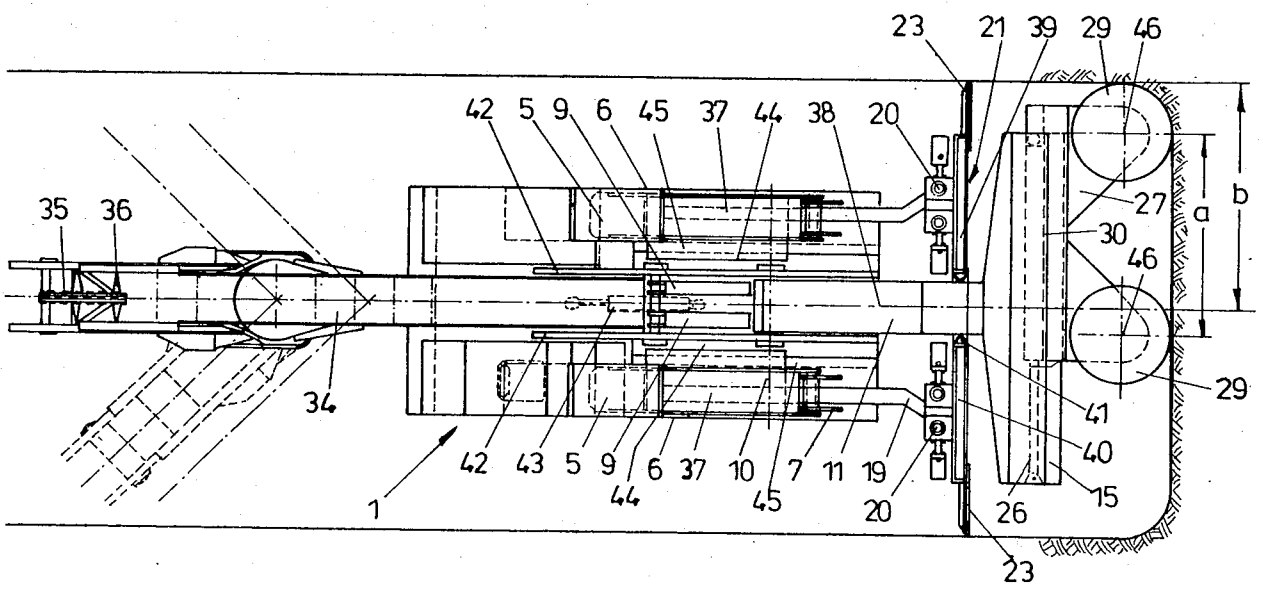

A swivellable conveyor 34 is connected to the rear end of the machine, the conveyor means being, as can be taken from FIG. 2, for example formed of scrapers 36 driven via a chain 35.

The representation according to FIG. 2 shows that the carrier construction 12 for the appliances 20 for drilling anchor bores and applying anchors and for the shielding 21 is shiftable in longitudinal direction of the cutting machine, noting that two cylinder-piston-aggregates 37 are supported against the frame 3 of the cutting machine 1 for forming the shifting drive means. Said both cylinder-piston-aggregates 37 are actuated such that the shielding 21 is advanced just in normal direction relative to the longitudinal axis 38 of the machine. The shielding 21 is subdivided into at least two parts 39 and 40 located at both sides of the cutting arm 11, and a slot 41 extending in height direction is provided between these both halves, said slot allowing movement of the cutting arm in height direction by actuating the swivelling cylinders 9.

The swivelling axis 10 of the cutting arm 11 is, like the swivelling axis of the removal means 15, supported in a shiftable frame 42, noting that this frame 42 can be shifted in the longitudinal axis 38 of the cutting machine 1 via a hydraulic cylinder-piston-aggregate 43. As shown, the frame 42 has lateral claws 44 which embrace guide rods 45 extending in longitudinal direction of the cutting machine. This is clearer shown in FIG. 3.

A carrier 27 designed as a slide carriage is guided within the guide 26 at the free end of the cutting arm 11 and has rotatably supported thereon cutting heads or cutting rolls 28 and 29, respectively, which are rotatably around axes 46 substantially extending perpendicular to the drift floor. As can be taken from FIG. 1, these cutting heads or cutting rolls 28 and 29, respectively, are hollow within there interior and house within their cavities drive means 47 formed of electro motors and gearings. The distance a of said both adjacent axes 46 corresponds to half of the width b of the drift to be advanced. The cutting heads or cutting rolls, respectively, which are located side by side when seen in a top plan view are advantageously driven in opposite sense for warranting a better stabilization and force transmission into the cutting arm 11.

The lateral margin of the shielding 21 is again reliably provided by sealings 23 being elastically deformable or being extendable and elastic. In an analogous manner, the slot 41, extending in height direction, of the shielding 21 is sealingly annexed to the cutting arm. In the construction shown, swivellability of the cutting arm is restricted to a substantially vertical swivellability. If horizontal swivellability shall be admitted, the slot 41 must be given a corresponding width and be lined with sealings being shiftable in horizontal direction or being elastically deformable. These sealings are schematically indicated by 48.

Figure 3:
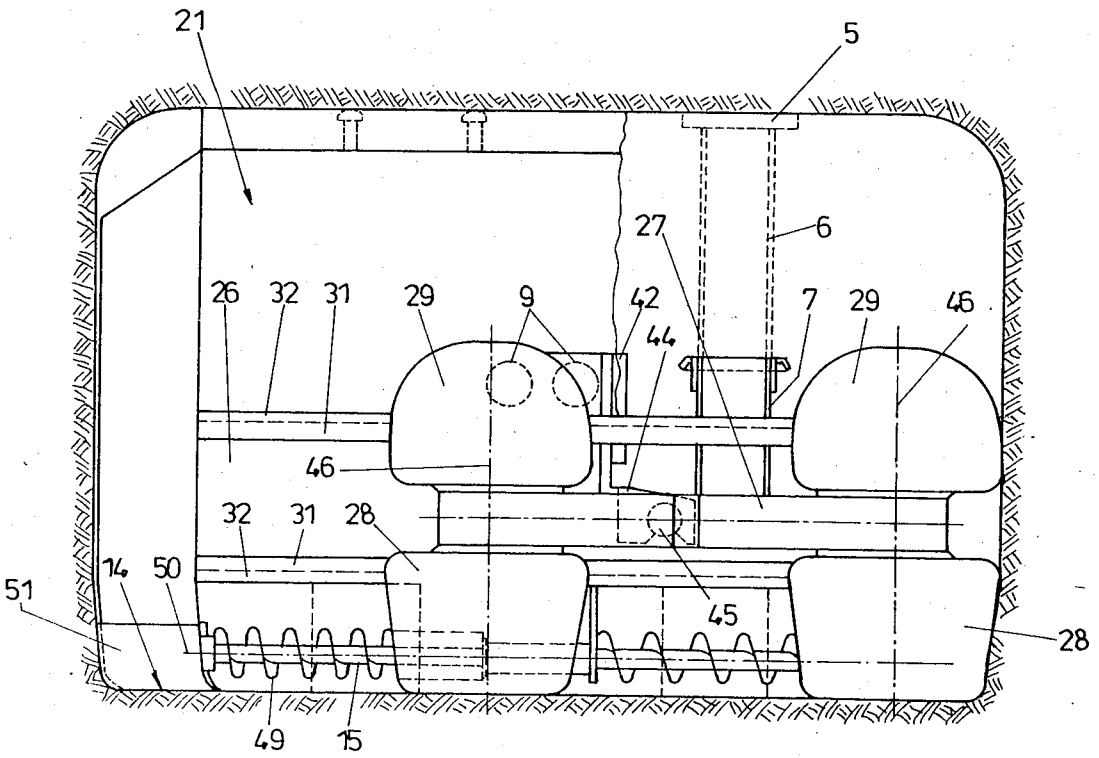

In the representation according to FIG. 3 there is additionally visible the removal means, formed of a conveyor screw 49, of the loading ramp 15. The conveyor screw 49 is rotatably supported for rotation around an axis 50 extending substantially transversely to the advance direction. For improving uptake of material laterally accumulating over the width of the loading ramp 15, there are provided outwardly swivellable shovels 51 which in their outwardly swivelled position extend till the side wall of the drift.

What is claimed is:

1. Device for sealing a drift cross section which can be driven by means of a movable cutting machine which includes a chassis, characterized in that the movable cutting machine comprises at least one carrier which is mounted so as to be shiftable in longitudinal direction of the machine and which has an end extending beyond the front end of the chassis, at least one wall element on said end, said wall element extending transversely to the longitudinal direction and shifting direction of the carrier and appliances on said wall element for drilling achor bores and applying anchors, in that the wall element has on its circumference adjustable sealings for contacting the drift profile and in that in the wall element there is provided a perforation corresponding to the outer contour and to the swivelling path of a swivellable cutting arm having arranged on its free end cutting tools (28, 29) and extending through the wall element, the inner circumference of said perforation comprising sealings for contacting the circumference of the cutting arm.

2. Device as claimed in claim 1 including guide means extending in longitudinal direction of the cutting machine for guiding said carrier.

3. Device as claimed in claim 1, characterized in that said cutting arm is mounted for shifting movement in longitudinal direction of the drift, the device further including independent shifting means for said arm and for said carrier.

4. Device as claimed in claim 1, characterized in that a removal means is mounted on a frame for longitudinal movement relative to said frame, said frame being carried by said chassis, said device including drive means, independent of other drive means, for shifting said removal means.

5. Device as claimed in claim 1, characterized in that said perforation in said wall element is a slot extending in height direction.

6. Device as claimed in claim 1, including locking means for locking the cutting machine against the drift roof.

* * * * *